US009822623B2

(12) United States Patent
Riel

(10) Patent No.: US 9,822,623 B2
(45) Date of Patent: Nov. 21, 2017

(54) MULTILATERAL OBSERVATION WELLS

(71) Applicant: CONOCOPHILLIPS COMPANY, Houston, TX (US)

(72) Inventor: Alexandre Riel, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 225 days.

(21) Appl. No.: 14/572,207

(22) Filed: Dec. 16, 2014

(65) Prior Publication Data

US 2016/0168967 A1 Jun. 16, 2016

Related U.S. Application Data

(60) Provisional application No. 61/917,130, filed on Dec. 17, 2013.

(51) Int. Cl.
*E21B 43/24* (2006.01)
*E21B 47/07* (2012.01)

(52) U.S. Cl.
CPC ..... *E21B 43/2406* (2013.01)

(58) Field of Classification Search
CPC .. E21B 43/24; E21B 43/2408; E21B 43/2406; E21B 47/06; E21B 47/065
USPC ..... 166/245, 50, 52, 250.01, 254.1
See application file for complete search history.

(56) References Cited

U.S. PATENT DOCUMENTS 5,868,210 A * 2/1999 Johnson ..... B04B 1/08 166/313
6,006,832 A * 12/1999 Tubel ..... E21B 23/03 166/113
6,253,853 B1 * 7/2001 George ..... E21B 34/14 166/316
6,318,457 B1 * 11/2001 Den Boer ..... E21B 34/066 166/207
8,056,624 B2 * 11/2011 Gates ..... E21B 43/2406 166/250.01
8,756,019 B2 * 6/2014 Pimenov ..... E21B 43/2406 702/12
9,347,312 B2 * 5/2016 Vincelette ..... E21B 43/2406
2014/0166280 A1 * 6/2014 Stone ..... E21B 43/12 166/268
2015/0354330 A1 * 12/2015 Stahl ..... E21B 43/2406 166/254.1
2016/0251957 A1 * 9/2016 McEwen-King ... E21B 43/2406

* cited by examiner

*Primary Examiner* — Kenneth L Thompson
(74) *Attorney, Agent, or Firm* — ConocoPhillips Company

(57) ABSTRACT

Methods and systems monitor conditions in a hydrocarbon reservoir with a multilateral observation well. The observation well may detect vertical development of a steam chamber that forms in the reservoir during thermal hydrocarbon recovery operations. Further, the observation well may include branches that extend to form vertical bores with temperature sensors for the monitoring, which may occur during the recovery operations performed in other wells since the observation well may be dedicated to only the monitoring.

18 Claims, 1 Drawing Sheet

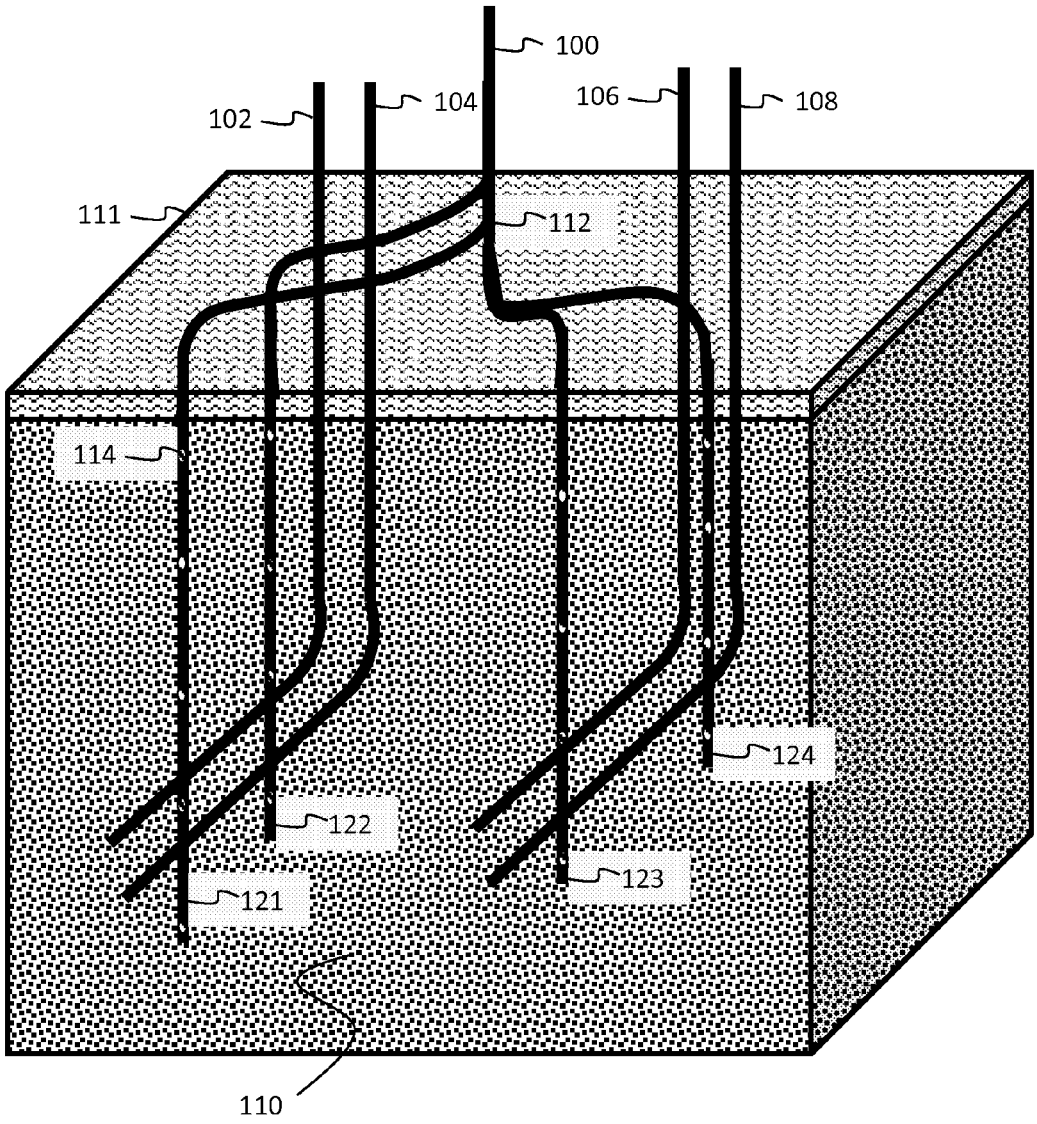
100
102
104
106
108
111
112
114
124
122
123
121
110

MULTILATERAL OBSERVATION WELLS

CROSS-REFERENCE TO RELATED APPLICATIONS

This application is a non-provisional application which claims benefit under 35 USC §119(e) to U.S. Provisional Application Ser. No. 61/917,130 filed Dec. 17, 2013, entitled "MULTILATERAL OBSERVATION WELLS," which is incorporated herein in its entirety.

STATEMENT REGARDING FEDERALLY SPONSORED RESEARCH

None.

FIELD OF THE INVENTION

Embodiments of the invention relate to observation wells for monitoring reservoir conditions during hydrocarbon recovery.

BACKGROUND OF THE INVENTION

Bitumen recovery from oil sands presents technical and economic challenges due to high viscosity of the bitumen at reservoir conditions. Thermal recovery processes such as steam assisted gravity drainage (SAGD) inject steam to heat the bitumen. The bitumen with reduced viscosity due to this heating then drains and is recovered.

Uniqueness of each reservoir due to factors, such as formation heterogeneities, creates uncertainties with respect to employing SAGD. Optimization of the SAGD to improve economics relies on understanding performance issues even though occurring underground making the issues often unknown. Since not possible to detect all desired information from well pairs used for the injection and production, prior approaches utilize separate vertical mono-bore observation wells.

The observation wells whether utilized in SAGD or other hydrocarbon production processes including water flood or other enhanced oil recovery procedures collect various data, such as reservoir temperature profiles. For example, the temperature profile provides indication of a resulting steam chamber development, which information may lead to making technical or operational adjustments. However, coverage at more than one vertical location through the reservoir may require intensive drilling to form several of the mono-bore observation wells.

Therefore, a need exists for methods and systems for cost effective monitoring of a reservoir during hydrocarbon production.

BRIEF SUMMARY OF THE DISCLOSURE

In one embodiment, a method of monitoring conditions in a hydrocarbon reservoir includes injecting steam into the reservoir and producing a mixture of hydrocarbons and condensate of the steam from the reservoir. The method further includes detecting vertical development of a resulting steam chamber in the reservoir with a multilateral observation well. The observation well includes branched bores in which temperature sensors are disposed.

According to one embodiment, a method of monitoring conditions in a hydrocarbon reservoir includes drilling a multilateral observation well having branches that extend to form a first bore and a second bore. In addition, the method includes disposing a first sensor in the first bore and a second sensor in the second bore. Obtaining data on the conditions with the sensors during hydrocarbon recovery operations occurs without use of the observation well for fluid communication with the reservoir in the hydrocarbon recovery operations.

For one embodiment, a system for monitoring conditions in a hydrocarbon reservoir includes a steam injection well extending toward horizontal in the reservoir and a production well extending toward horizontal in the reservoir for production of fluids heated by steam introduced through the injection well. A multilateral observation well includes bores branched in a formation above the reservoir such that the bores enter the reservoir at spaced locations and traverse downward through the reservoir. Temperature sensors disposed in the bores of the observation well monitor a steam chamber resulting from introduction of the steam through the injection well into the reservoir.

BRIEF DESCRIPTION OF THE DRAWINGS

A more complete understanding of the present invention and benefits thereof may be acquired by referring to the following description taken in conjunction with the accompanying drawings.

The FIGURE is a schematic of a well configuration with a multilateral observation wellbore for monitoring two steam assisted gravity drainage well pairs, according to one embodiment of the invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Embodiments of the invention relate to monitoring conditions in a hydrocarbon reservoir with a multilateral observation well. The observation well may detect vertical development of a steam chamber that forms in the reservoir during thermal hydrocarbon recovery operations. Further, the observation well may include branches that extend to form vertical bores with temperature sensors for the monitoring, which may occur during the recovery operations performed in other wells since the observation well may be dedicated to only the monitoring.

The FIGURE illustrates an exemplary system with a multilateral observation well 100. For some embodiments, the observation well 100 enables sensing conditions during a thermal recovery operation, such as steam assisted gravity drainage (SAGD) as depicted. Various other recovery operations and alternative wellbore configurations may also utilize the observation well 100 and features described herein.

A first injection well 102, a first production well 104, a second injection well 106 and a second production well 108 all extend into a hydrocarbon reservoir 110 in proximity to the observation well 100 to enable monitoring of the conditions during hydrocarbon recovery operations using the injection and production wells 102, 104, 106, 110. The injection and production wells 102, 104, 106, 110 may each include horizontal lengths traversing through the reservoir 110. The first injection and production wells 102, 104 provide a first SAGD well pair spaced in a lateral direction from a second SAGD well pair formed by the second injection and production wells 106, 108.

In operation, steam introduced through the horizontal lengths of the injection wells 102, 106 heats the hydrocarbons and condenses. A mixture of condensate and the hydrocarbons that are heated then drains to the production wells 104, 108, which may be disposed below and parallel to respective ones of the injection wells 102, 106. Steam chambers develop in the reservoir 110 above the injection wells 102, 106 and below an overburden layer 111 as a result of the injecting and producing.

The observation well 100 includes one or more junctions 112 where at least one lateral borehole originates. For example, the observation well 100 branches to form a first bore 121, second bore 122, third bore 123 and fourth bore 124. Placement of the junctions 112 above the reservoir 110 and in an area of formation, such as the overburden layer 111, may avoid operational difficulties and unwanted rapid steam chamber coalescence between each of the bores 121-124 of the observation well 100.

The overburden layer 111 provides lower permeability to fluid flow than the reservoir 110. Therefore, the overburden layer 111 obstructs or prevents fluid communication between the reservoir 110 and lengths of the bores 121-124 above the reservoir 110 and may be impermeable to flow of fluids, such as steam. For some embodiments, formations of shale form the overburden layer 111.

The bores 121-124 of the observation well 100 may extend from the junctions 112 toward horizontal while remaining above the reservoir 110. The bores 121-124 may then turn downward and enter the reservoir 110. Since the bores 121-124 may diverge from one another in radial directions from the junctions 112, each of the bores 121-124 may enter the reservoir 110 at spaced locations to facilitate avoidance of the steam chamber coalescence.

Upon entering the reservoir 110, the bores 121-124 traverse downward in a vertical direction through the reservoir 110 toward a depth of the injection wells 102, 106. In some embodiments, the first bore 121 passes through the reservoir 110 closer to a toe of the first injection well 102 than a heel of the first injection well 102. The second bore 122 may pass closer to the heel than the toe of the first injection well 102 to enable monitoring the conditions at different targeted locations along the first SAGD well pair.

The observation well 100 may further provide ability to monitor the second SAGD well pair with the third and fourth bores 123, 124. As such, the first and second bores 121, 122 of the observation well 100 may pass closer to the first injection well 102 than the second injection well 106. The third and fourth bores 123, 124 of the observation well 100 furthermore pass closer to the second injection well 106 than the first injection well 102.

Sensors 114, such as temperature and/or pressure sensors, disposed in the bores 121-124 measure the conditions and may facilitate monitoring the steam chamber developing in the reservoir 110. For example, detection of a vertical temperature profile along the bores 121-124 identifies height of the steam chamber based on where the temperature drops due to the steam chamber not yet reaching higher in the formation. The observation well 100 may include several of the sensors 114 spaced along vertical lengths of each of the bores 121-124 to provide such profiles at desired locations in the reservoir 110.

In some embodiments, the detecting with the observation well 100 takes place concurrent with the injecting and producing through the injection and production wells 102, 104, 106, 108. Such hydrocarbon recovery operations occur without relying on fluid communication through the observation well 100 between surface and the reservoir 110 since this flow pathway may be blocked. Collection of data from the observation well 100 reduces uncertainties related to reservoir description or process performance and allows operators to improve recovery by adjusting at least one of the injecting and the producing based on the data.

For example, indication from the first bore 121 of relative smaller steam chamber development compared to indication from the second bore 122 may trigger adjustment of flow control devices to direct additional steam to the toe compared to the heel of the first injection well 102. Likewise, the first and second bores 121, 122 may detect a relative smaller steam chamber development compared to that detected by the third and fourth bores 123, 124. Adjustment of steam injection into each of the injection wells 102, 106 relative to one another may facilitate desired merging of the steam chambers between adjacent well pairs.

Completion of the observation well 100 includes logging each of the bores 121-124 intersecting different sections of the reservoir 110 to enhance understanding of the reservoir properties. The observation well 100 utilizes a single surface well pad to reduce drilling days and lower capital expenditure compared to intensive drilling otherwise required to form individual unbranched wells. Further, use of only one well pad with the observation well 100 instead of multiple well pads to obtain desired data reduces surface footprint and undesired land disturbances.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. A method of monitoring conditions in a hydrocarbon reservoir, comprising:

injecting steam into the reservoir;

producing a mixture of hydrocarbons and condensate of the steam from the reservoir; and detecting vertical development of a resulting steam chamber in the reservoir with a multilateral observation well having temperature sensors disposed in branched bores of the observation well, wherein junctions along the observation well where the bores originate are in a formation above the reservoir such that the bores enter the reservoir at spaced locations and traverse downward through the reservoir.

2. The method according to claim 1, further comprising blocking fluid communication through the observation well between surface and the reservoir.

3. The method according to claim 1, wherein a first of the bores is disposed closer to an injection and production first well pair than an injection and production second well pair and a second of the bores is disposed closer to the second well pair than the first well pair.

4. The method according to claim 1, wherein the temperature sensors measure temperature along vertical lengths of the bores.

5. The method according to claim 1, wherein the temperature sensors are spaced along a first of the bores and spaced along a second of the bores.

6. The method according to claim 1, wherein the injecting of the steam is through a horizontal injection well that is disposed above and parallel to a production well to form a steam assisted gravity drainage well pair.

7. The method according to claim 1, wherein the injecting of the steam is through a horizontal injection well and a first of the bores is disposed closer to a toe of the injection well than a heel of the injection well and a second of the bores is disposed closer to the heel than the toe.

8. The method according to claim 1, further comprising sensing a different parameter in addition to temperature with instrumentation in the branched bores of the observation well.

9. The method according to claim 1, further comprising sensing pressure in the branched bores of the observation well.

10. The method according to claim 1, further comprising adjusting at least one of the injecting and the producing based on the detecting with the observation well.

11. A method of monitoring conditions in a hydrocarbon reservoir, comprising:

drilling a multilateral observation well having branches that extend to form a first bore and a second bore;

disposing a first sensor in the first bore and a second sensor in the second bore; and obtaining data on the conditions with the sensors during hydrocarbon recovery operations and without use of the observation well for fluid communication with the reservoir in the hydrocarbon recovery operations, wherein junctions along the observation well where the bores originate are in an area of formation obstructed from fluid communication with the reservoir by a lower permeability layer of the formation.

12. The method according to claim 11, wherein the sensors are temperature sensors.

13. The method according to claim 11, wherein the sensors are pressure sensors.

14. The method according to claim 11, wherein junctions along the observation well where the bores originate are in an area of formation separated by a lower permeability layer of the formation than the reservoir such that the bores enter the reservoir at spaced locations and traverse in a vertical direction through the reservoir.

15. A system for monitoring conditions in a hydrocarbon reservoir, comprising:

a steam injection well extending toward horizontal in the reservoir;

a production well extending toward horizontal in the reservoir for production of fluids heated by steam introduced through the injection well;

a multilateral observation well having bores branched in a formation above the reservoir such that the bores enter the reservoir at spaced locations and traverse downward through the reservoir; and temperature sensors disposed in the bores of the observation well for monitoring a steam chamber resulting from introduction of the steam through the injection well into the reservoir.

16. The system according to claim 15, wherein fluid communication is blocked through the observation well between surface and the reservoir.

17. The system according to claim 15, wherein the temperature sensors measure temperature along vertical lengths of the bores.

18. The system according to claim 15, wherein the temperature sensors are spaced along a first of the bores and spaced along a second of the bores.

* * * * *